US008277095B2

(12) United States Patent
Juang et al.

(10) Patent No.: US 8,277,095 B2
(45) Date of Patent: Oct. 2, 2012

(54) LIGHT EMITTING DIODE LAMP

(75) Inventors: Jia-Yi Juang, Taipei County (TW); Shih-Hao Hung, Taipei County (TW); Hsien-Chang Wu, Taipei County (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 192 days.

(21) Appl. No.: 12/839,419

(22) Filed: Jul. 20, 2010

(65) Prior Publication Data

US 2011/0019438 A1 Jan. 27, 2011

(30) Foreign Application Priority Data

Jul. 24, 2009 (TW) ..... 9821366 U

(51) Int. Cl.
*F21V 8/00* (2006.01)

(52) U.S. Cl. ..... 362/421; 362/371; 362/647

(58) Field of Classification Search ..... 362/418–421, 362/647, 427–430, 371, 287, 249.02, 249.03
See application file for complete search history.

(56) References Cited

U.S. PATENT DOCUMENTS

| | | | | |
|---|---|---|---|---|
| 4,321,660 | A * | 3/1982 | Sokol | 362/368 |
| 5,941,630 | A * | 8/1999 | Finke et al. | 362/371 |
| 7,631,987 | B2 * | 12/2009 | Wei | 362/294 |
| 7,695,170 | B1 * | 4/2010 | Baldwin et al. | 362/371 |

* cited by examiner

*Primary Examiner* — Julie Shallenberger
(74) *Attorney, Agent, or Firm* — Jianq Chyun IP Office

(57) ABSTRACT

A light emitting diode lamp includes a lamp shade, a light emitting diode light source, a universal joint and a power connector. The light emitting diode light source is disposed in the lamp shade. The universal joint includes a first connecting part and a second connecting part. The first connecting part is fixed to the lamp shade. The second connecting part is rotatably connected to the first connecting part and fixed to the power connector.

3 Claims, 5 Drawing Sheets

100

LIGHT EMITTING DIODE LAMP

CROSS-REFERENCE TO RELATED APPLICATION

This application claims the priority benefit of Taiwan application serial no. 98213666, filed on Jul. 24, 2009. The entirety of the above-mentioned patent application is hereby incorporated by reference herein and made a part of specification.

BACKGROUND OF THE INVENTION

1. Field of the Invention

The invention relates to a lamp and more particularly to a light emitting diode (LED) lamp.

2. Description of Related Art

Light emitting diodes (LEDs) are semiconductor devices. Light emitting chips are mainly fabricated using compounds of group III-V elements, for example, gallium phosphide (GaP) or gallium arsenide (GaAs). Moreover, LEDs emit light by converting electric energy into light energy. In details, LEDs apply currents to compound semiconductors so as to release excess energy in the form of light through the binding of electrons and holes. Since the light emitting phenomenon of LEDs does not occur through thermo-luminescence or discharge-luminescence, the lifespan of LEDs can be longer than one hundred thousand hours. LEDs further include advantages such as fast response speed, small volume, energy saving, low pollution, high reliability, suitable for mass production, and so on. Thus, LEDs can be widely applied in various fields, for instance, large display boards, traffic lights, cellular phones, scanner, light sources of fax machines, LED lamps, and the like.

An LED lamp is constituted by a lamp shade, an LED light source in the lamp shade, a power connector connected to the lamp shade, and so on. The power connector is plugged into an external socket to provide the light source required by the LED lamp. The lamp shade and the power connector are generally assembled together through attaching, the lamp shade thereby can not rotate relative to the power connector for adjusting an illumination direction.

SUMMARY OF THE INVENTION

The invention is directed to a light emitting diode (LED) lamp, where a lamp shade thereof is capable of rotating relative to a power connector so as to adjust an illumination direction.

The invention is directed to an LED lamp including a lamp shade, an LED light source, a universal joint, and a power connector. The LED light source is disposed in the lamp shade. The universal joint includes a first connecting part and a second connecting part. The first connecting part is fixed to the lamp shade. The second connecting part is rotatably connected to the first connecting part and fixed to the power connector.

In one embodiment of the invention, the first connecting part has an opening, the second connecting part has a spherical structure, and the first connecting part is rotatably mounted on the spherical structure through the opening.

In one embodiment of the invention, the power connector includes a casing, a switch board, and a conductive wire. The switch board is disposed in the casing. The conductive wire is electrically connected between the switch board and the LED light source.

In one embodiment of the invention, the universal joint has a channel and the conductive wire is electrically connected between the switch board and the LED light source through the channel.

In one embodiment of the invention, the casing has an assembly aperture and an annular slot located in the casing. The second connecting part has an annular flange, where the second connecting part is inserted to the casing from the assembly aperture and the annular flange is wedged to the annular slot.

In light of the foregoing, a universal joint is disposed between the lamp shade and the power connector in the invention. The lamp shade can thus rotate relative to the power connector through the universal joint to adjust the illumination direction.

In order to make the aforementioned and other features and advantages of the invention more comprehensible, several embodiments accompanied with figures are described in detail below.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF EMBODIMENTS

Figure 1:
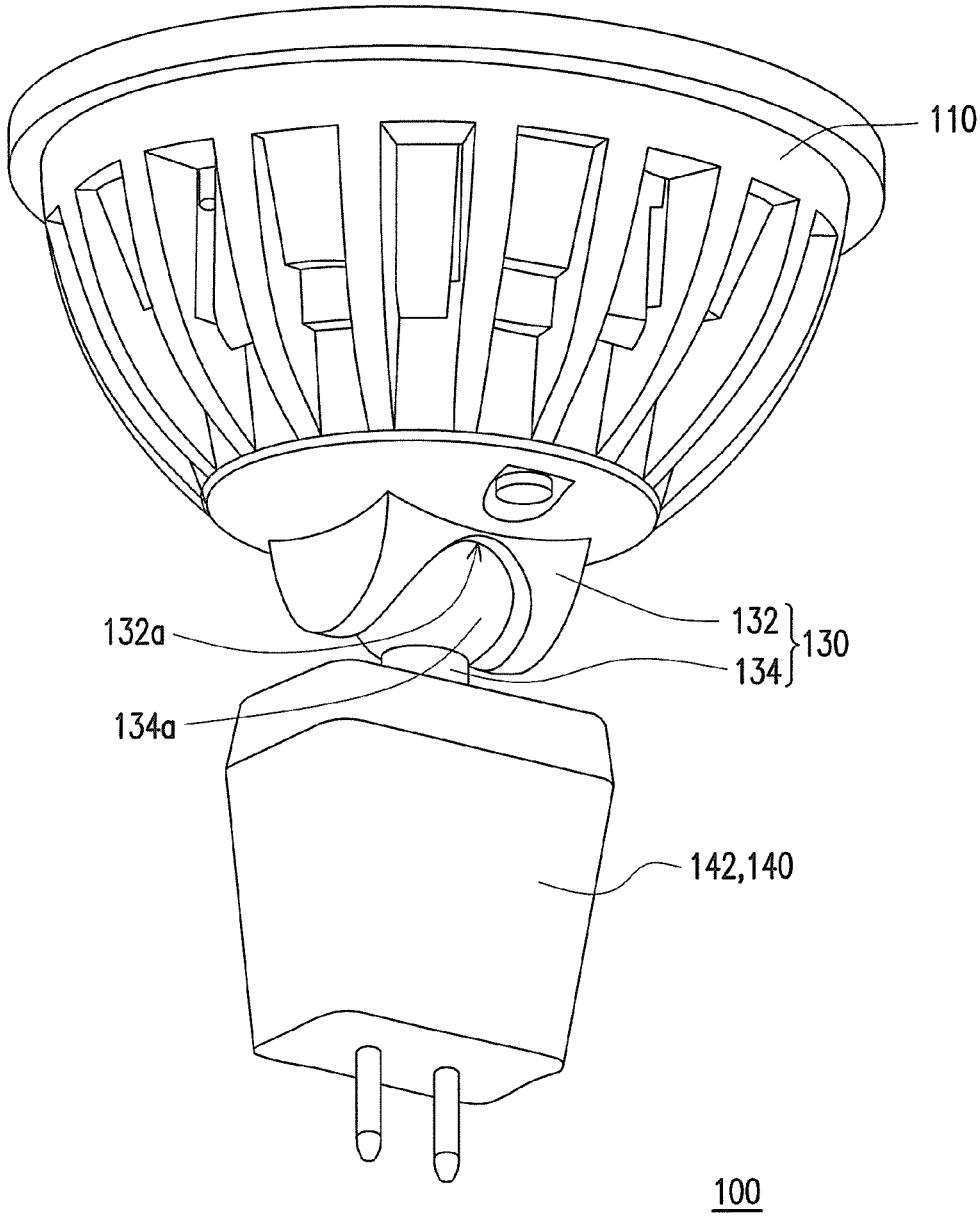
FIG. 1 is a schematic three-dimensional (3D) diagram illustrating a light emitting diode (LED) lamp according to an embodiment of the invention.
Figure 2:
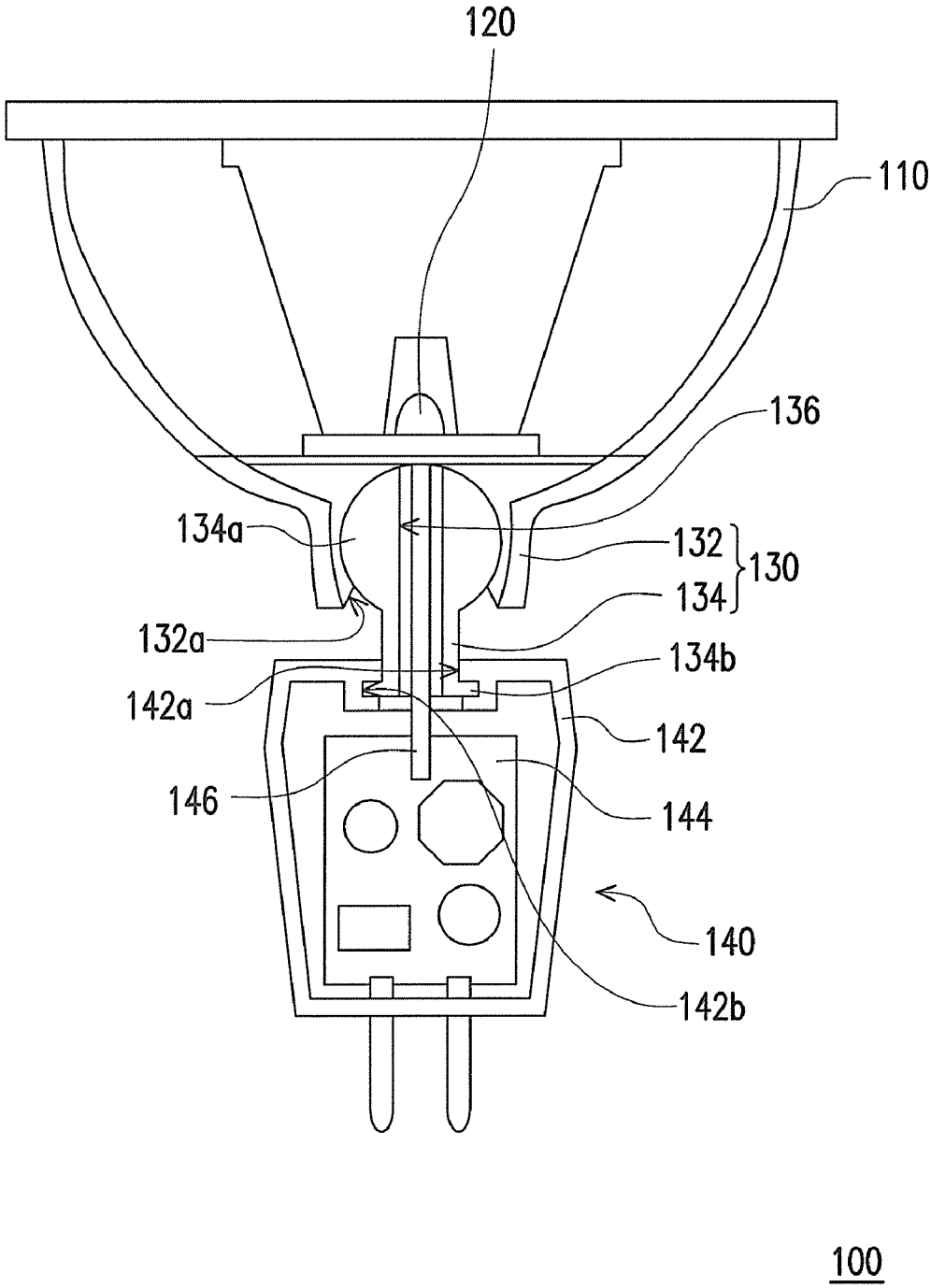
FIG. 2 shows a partial perspective view of the LED lamp in FIG. 1.

FIG. 1 is a three-dimensional (3D) diagram illustrating a light emitting diode (LED) lamp according to an embodiment of the invention. FIG. 2 shows a partial perspective view of the LED lamp in FIG. 1 Referring to FIGS. 1 and 2, an LED lamp 100 of the present embodiment includes a lamp shade 110, an LED light source 120, a universal joint 130, and a power connector 140. The LED light source 120 is disposed in the lamp shade 110. The universal joint 130 includes a first connecting part 132 and a second connecting part 134. The first connecting part 132 is fixed to the lamp shade 110. The second connecting part 134 is rotatably connected to the first connecting part 132 and fixed to the power connector 140.

It should be noted the universal joint 130 is connected between that the lamp shade 110 and the power connector 140 in the present embodiment. Consequently, the lamp shade 110 can rotate relative to the power connector 140 through the universal joint 130 to adjust an illumination direction. Specifically, when the first connecting part 132 rotates relative to the second connecting part 134, the lamp shade 110 is driven by the first connecting part 132 and thus rotates relative to the second connecting part 134 and the power connector 140.

Figure 3:
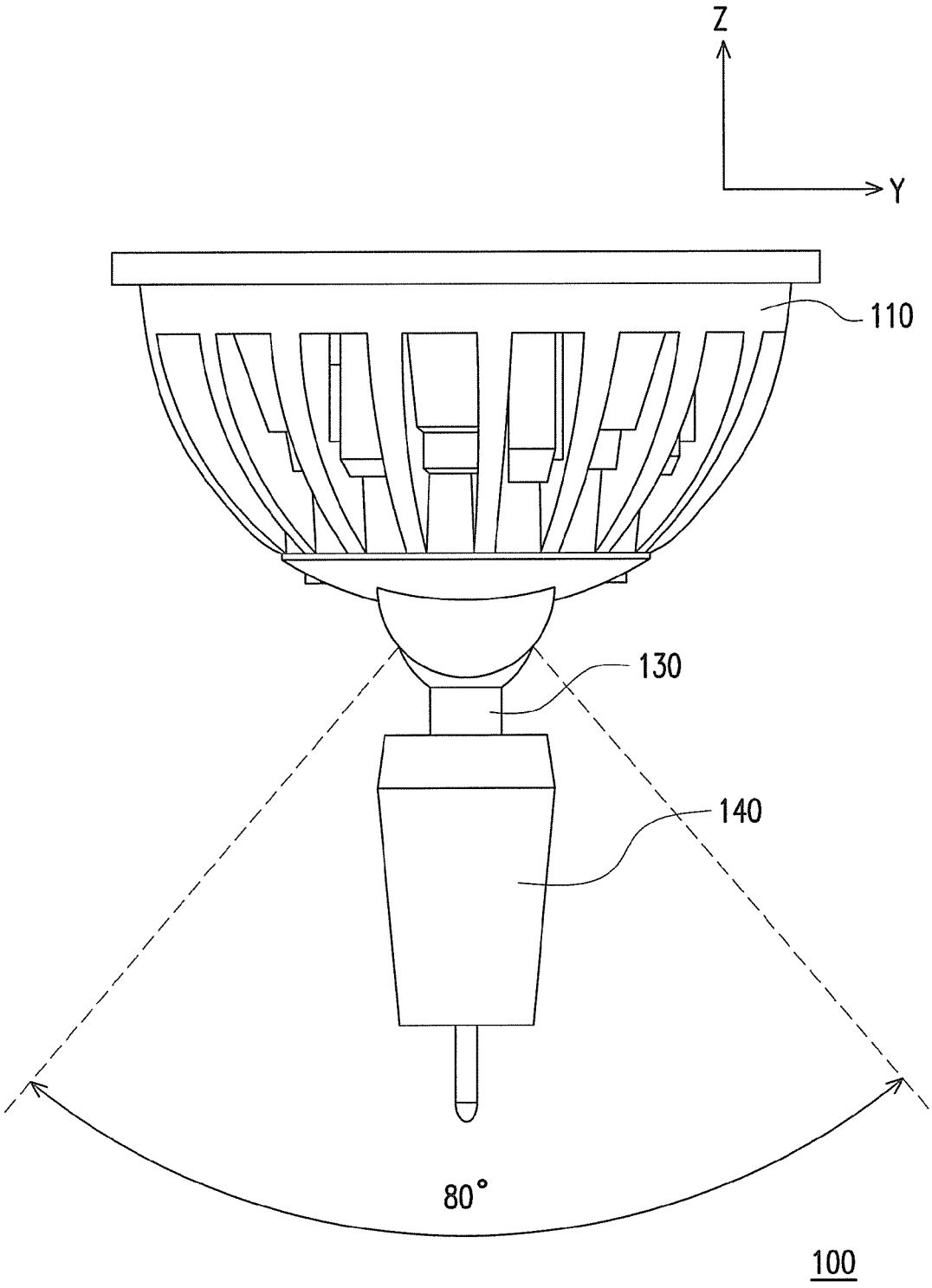
FIG. 3 is a schematic side view of the LED lamp in FIG. 1.
Figure 4:
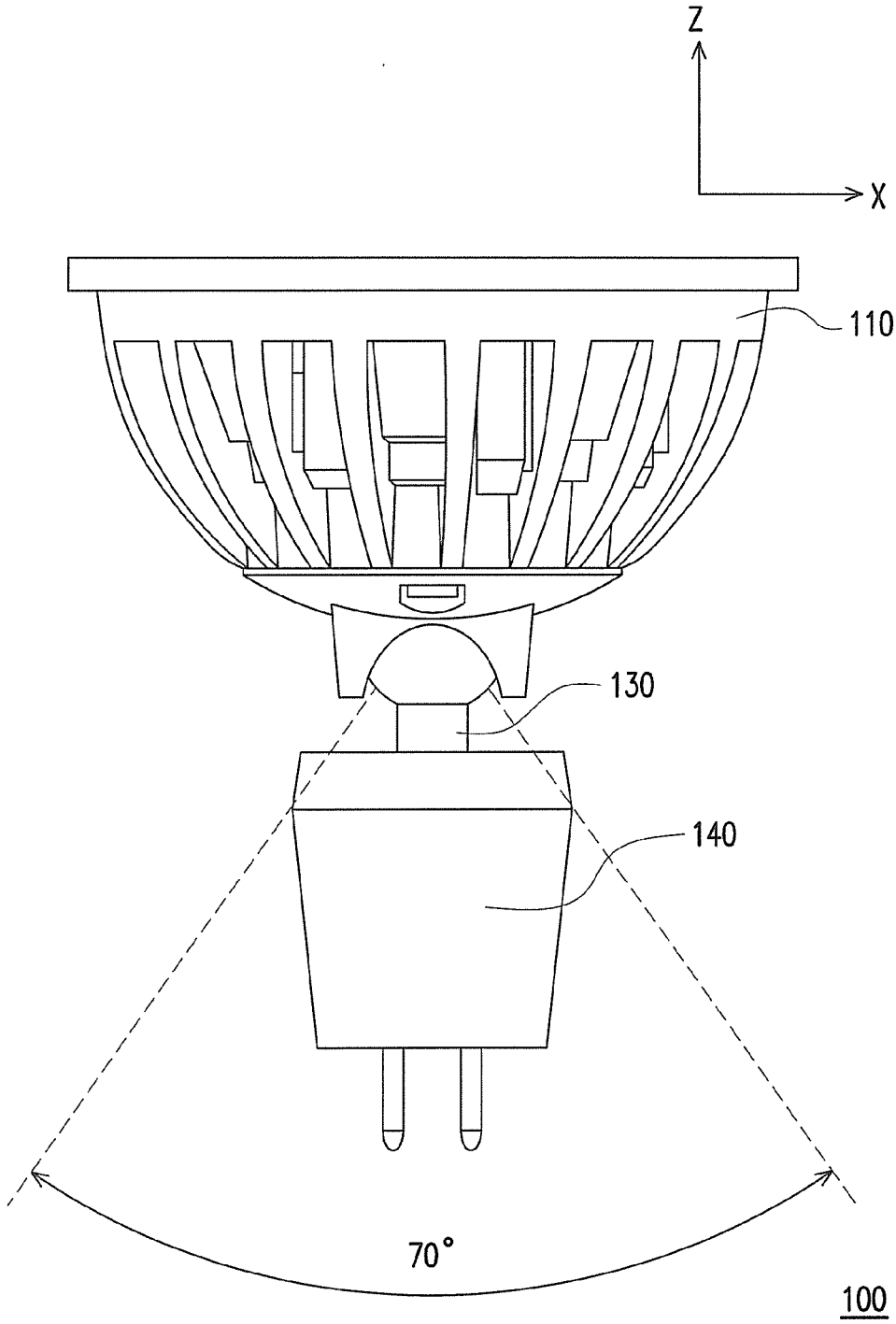
FIG. 4 is a schematic side view of the LED lamp in FIG. 1 from another viewing angle.

FIG. 3 is a schematic side view of the LED lamp in FIG. 1. FIG. 4 is a schematic side view of the LED lamp in FIG. 1 from another viewing angle. Referring to FIGS. 3 and 4, in the present embodiment, the lamp shade 110 and the power connector 140 have, for example, a relative rotation range of 80° on the YZ plane (as shown in FIG. 3), and a relative rotation range of 70° on the XZ plane (as shown in FIG. 4), for example. Moreover, the lamp shade 110 can rotate 360° relative to the power connector 140 along the Z axis. However, the invention is not limited to the rotation ranges aforementioned. In other embodiments, the rotation range can be adjusted by altering the design of the universal joint 130.

Referring to FIGS. 1 and 2, in the present embodiment, the first connecting part 132 has an opening 132*a* and the second connecting part 134 has a spherical structure 134*a*. The first connecting part 132 is rotatably mounted on the spherical structure 134*a* through the opening 132*a*, such that the spherical structure 134*a* suitably rotates along each axis relative to the first connecting part 132. The spherical structure 134*a* is connected to the first connecting part 130 through close fitting, so that the spherical structure 134*a* does not come loose when rotating.

Referring to FIG. 2, in the present embodiment, the power connector 140 includes a casing 142, a switch board 144, and a conductive wire 146. The switch board 144 is disposed in the casing 142. The conductive wire 146 is electrically connected between the switch board 144 and the LED light source 120. When the power connector 140 is plugged into an external socket, the power is transmitted to the LED light source 120 sequentially through the switch board 144 and the conductive wire 146, so that the LED light source 120 provides illumination.

In details, the universal joint 140 of the present embodiment has a channel 136. The conductive wire 146 connected to the switch board 144 extends into the lamp shade 110 through the channel 136 so as to be electrically connected to the LED light source 120. It should be noted that the conductive wire 146 is, for example, a flexible wire, and bends with the relative rotation of the first connecting part 132 and the second connecting part 134.

Figure 5:
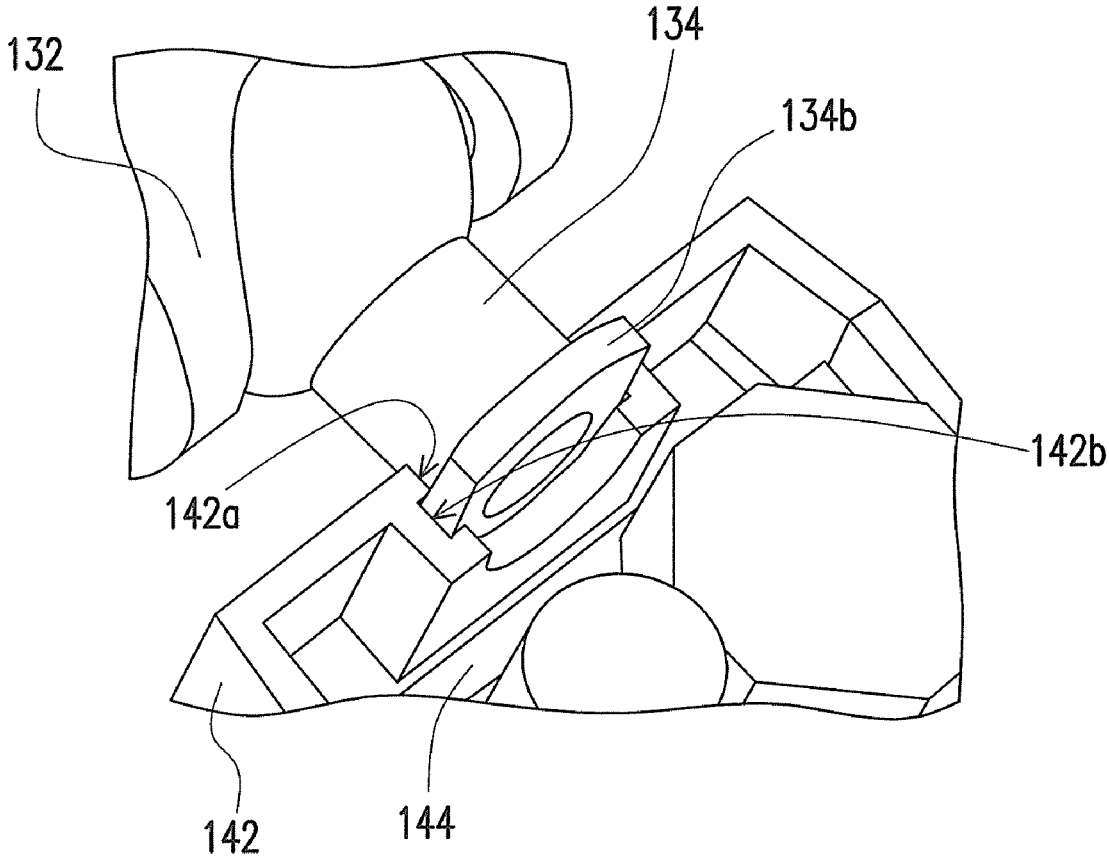
FIG. 5 shows a partial 3D diagram of the LED lamp in FIG. 1.

FIG. 5 shows a partial 3D diagram of the LED lamp in FIG. 1. Referring to FIGS. 2 and 5, the casing 142 of the present embodiment has an assembly aperture 142*a* and an annular slot 142*b* located in the casing 142. The second connecting part 134 has an annular flange 134*b*. Here, the second connecting part 134*a* is inserted to the casing 142 through the assembly aperture 142*a* and the annular flange 134*b* is wedged to the annular slot 142*b* so as to fix the second connecting part 134 to the power connector 140.

In summary, a universal joint is disposed between the lamp shade and the power connector in the invention. The lamp shade can thus rotate relative to the power connector through the universal joint to adjust the illumination direction. In addition, the universal joint has a channel, so the conductive wire can be connected between the switch board and the LED light source through the channel.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A light emitting diode lamp, comprising:
- a lamp shade;
- a light emitting diode light source, disposed in the lamp shade;
- a universal joint, comprising:
  - a first connecting part, fixed to the lamp shade;
  - a second connecting part, rotatably connected to the first connecting part; and
- a power connector, wherein the second connecting part is fixed to the power connector, wherein the power connector comprises:
  - a casing;
  - a switch board, disposed in the casing; and
  - a conductive wire, electrically connected between the switch board and the light emitting diode light source, wherein the casing has an assembly aperture and an annular slot, and the second connecting part has an annular flange, wherein the second connecting part is inserted to the casing from the assembly aperture, and the annular flange is wedged to the annular slot.

2. The light emitting diode lamp as claimed in claim 1, wherein the first connecting part has an opening, the second connecting part has a spherical structure, and the first connecting part is rotatably mounted on the spherical structure through the opening.

3. The light emitting diode lamp as claimed in claim 1, wherein the universal joint has a channel and the conductive wire is electrically connected between the switch board and the light emitting diode light source through the channel.

* * * * *